United States Patent [19]

Sylvester

[11] 4,042,396

[45] Aug. 16, 1977

[54] FLUID RECEIVING TRAP WITH AIR RELEASING MEANS COMPRISING A PROCESSING COMPOSITION IMPERVIOUS LAYER

[75] Inventor: Robert A. Sylvester, Hilton, N.Y.

[73] Assignee: Eastman Kodak Company, Rochester, N.Y.

[21] Appl. No.: 595,451

[22] Filed: July 11, 1975

[51] Int. Cl.[2] ..... G03C 1/48; G03D 9/02

[52] U.S. Cl. ..... 96/76 C; 354/304

[58] Field of Search ..... 96/76 C, 76 R; 354/304

[56] References Cited

U.S. PATENT DOCUMENTS

| | | | |
|---|---|---|---|
| 2,500,422 | 3/1950 | Land | 96/76 R |
| 2,686,716 | 8/1954 | Land | 96/76 R |
| 3,607,285 | 9/1971 | Chen | 96/76 C |
| 3,615,540 | 10/1971 | Land | 96/76 C |
| 3,619,193 | 11/1971 | Knight | 96/76 C |
| 3,783,075 | 1/1974 | Land | 96/76 R |
| 3,816,128 | 6/1974 | Chen | 96/76 C |

*Primary Examiner*—David Klein
*Assistant Examiner*—Richard L. Schilling
*Attorney, Agent, or Firm*—J. A. Matthews

[57] ABSTRACT

In a photographic film unit having a pair of sheets connected in superposition with a photosensitive layer located between the sheets, a container carrying a quantity of processing composition is arranged to provide for the discharge of the composition to between the sheets at the leading end of the film unit. A fluid receiver or trap is provided at the trailing end of the film unit to receive and store excess processing composition after it has been spread between the sheets. The trap includes trap spacing means, trap cover means, and trap-venting means formed of a plurality of holes through the trap cover means. The improvement comprises a processing-composition-impervious layer on the surface of and substantially coextensive with the trap spacing means adjacent the trap cover means whereby the processing composition is restrained from reaching the trap-venting holes without restraining air or gas from reaching the venting holes for escape from the film unit. The impervious layer may be sealed to the trap cover means transversely of the film unit along the trailing edge of the trap spacing means to improve the restraint of the processing composition.

8 Claims, 4 Drawing Figures

FLUID RECEIVING TRAP WITH AIR RELEASING MEANS COMPRISING A PROCESSING COMPOSITION IMPERVIOUS LAYER

BACKGROUND OF THE INVENTION

Self-processing photographic film units are now available which are completely self-contained and are adapted to be employed in a camera in which the film unit is exposed and then processed by being moved between a pair of pressure-applying members. The components of the film unit are assembled to form an integral structure and the integrity of this structure is maintained during exposure, processing and viewing, thereby making it unnecessary to store, handle and/or move separately, individual elements of the film unit, and minimizing the complexity of the structure required to contain and manipulate the film unit to effect exposure and processing thereof. Such a film unit structure is attractive, includes a minimum of simple and easily assembled components, is of a minimum size in relation to image size and generally includes substantially no excess materials.

The film units generally comprise two separate, flexible sheetlike elements including a first or image-recording sheet including a layer containing a photosensitive image-recording material and a second sheet for aiding in the distribution of a processing fluid as a layer of predetermined thickness in contact with an exposed area of the photosensitive material. A rupturable container filled with the processing fluid is disposed along one edge of the film unit, in a manner well known in the art. After the processing fluid has been spread from the leading end of the film unit between the sheets toward the trailing end therof. excess processing fluid is trapped and retained within the film unit at the trailing end thereof.

During spreading, the processing fluid is advanced between the sheet-like elements, or sheets, as a mass located immediately ahead of the pressure-applying members and extending from side-to-side of the film unit. Even if the film unit is assembled such that substantially all air is excluded from between the sheets by pressing them into face-to-face contact throughout substantially the entire area of the facing surfaces, it is difficult to exclude all air from the film unit during manufacture and, unless the binding element is adhered to the sheets so as to substantially prevent the entry of air, air may enter the film unit after manufacture during storage. It has been found that air (or any gas) located between the sheets during spreading of the processing fluid should be advanced ahead of the mass of fluid and should be permitted to escape from between the sheets at the trailing end of the film unit. Otherwise, the air or gas can be entrained as air bubbles in the rapidly advancing mass of fluid, with the bubbles forming voids or discontinuities in the layer of fluid. Moreover, it has been found that air pushed ahead of the mass of fluid can, if not permitted to escape, be compressed at the trailing end of the film unit during spreading, only to expand back into the image after spreading is complete. This, too, forms voids or discontinuities in the fluid which are manifested in the image as discolored spots or regions.

Thus, it is necessary to provide for venting or otherwise expelling the air from between the sheets without inhibiting the spreading of the processing fluid, while at the same time preventing the processing fluid from escaping from between the sheets. It is known that escape of the processing fluid from between the sheets can be effectively prevented by the provision of trapping spaces and a liquid-tight retaining element secured to the outer borders of the sheets. Examples of trap structures and retaining elements are disclosed in U.S. Pat. Nos. 2,500,422, 2,627,460, 2,686,716, 3,589,904, 3,607,285, 3,615,540 and 3,619,193.

It is also known that a film unit can be vented in such a way as not to inhibit the release or escape of air, while at the same time minimizing the escape of processing fluid from the film unit. A number of expedients are known for releasing air from the trailing end of the film unit. For example, the trap cover may be perforated or slit in the trap region, as shown in U.S. Pat. Nos. 2,627,460, 3,615,540 and 3,619,193. The perforations or slits are preferably in the form of pinholes or very fine slits that are almost invisible, but which will readily pass air while resisting the passage of the viscous processing fluid. In other arrangements narrow regions of the binding element may be left unbonded to thereby provide for the escape of air, as shown in U.S. Pat. No. 3,589,904. In still other arrangements, the binding element or at least the trailing end portion thereof may be formed of a porous material which has pores of a size through which air may pass with a minimum of resistance and yet effectively preclude passage of the viscous processing liquid. Porous materials offering little resistance to the passage of air and essentially impermeable to viscous liquids include porous polymeric film and fibrous material commonly used as filters. Such materials may be coated with a water-proof agent to increase their impermeability to aqueous liquids without reducing their gas permeability. See U.S. Pat. No. 2,627,460.

However, it has been found with each of the above venting arrangements that prevention of the escape of the processing liquid is not completely assured. While many of those arrangements do generally preclude the escape of processing liquid during the spreading thereof, it is still possible for the user to subsequently, purposely or inadvertently, manipulate the trap portion of the film unit to such an extent that the processing liquid if forced out of the vent holes regardless of their size.

SUMMARY OF THE INVENTION

In accordance with one aspect of the present invention there is provided a film unit comprising a photosensitive sheet and a second sheet, with a coupling member permanently securing the sheets together in superposed relationship. A container for processing composition is disposed at one end of the film unit and a trap for excess processing composition is disposed at the other end of the film unit. A trap spacing element is provided along with a trap cover means of sheet material which overlies the spacing means. Trap venting means comprising a plurality of holes through the trap cover means is provided which permits the escape of air (gas) from the film unit. The improvement comprises a processing-composition-impervious layer disposed between the trap spacing means and the trap cover means whereby air or other gas may escape without leakage of the processing composition through the vent holes.

In accordance with another aspect of the present invention there is provided a film unit comprising a photosensitive sheet and a second sheet, with a coupling member securing the sheets together along their lateral edges in superposed relationship. A container for processing composition is disposed at the leading end of the film unit and a trap for excess processing composition is disposed at the trailing end of the film unit. The trap includes a trap spacing means and trap cover means, with trap-venting means comprising a plurality of holes through the trap cover means. The improvement comprises a processing-composition-impervious layer on the surface of and substantially coextensive with the trap spacing means adjacent the trap cover means. The impervious layer is sealed to the trap cover means transversely of the film unit along the trailing edge of the trap spacing means whereby the processing composition is restrained from reaching the trap-venting holes without restraining air or other gas from reaching the venting holes for escape from the film unit.

The various features of novelty which characterize the present invention are pointed out with particularity in the claims annexed hereto and forming part of this specification. For a better understanding of the invention, its operating advantages and the specific objects obtained by its use, reference should be had to the accompanying drawings and descriptive matter in which two embodiments of the present invention are illustrated and described.

BRIEF DESCRIPTION OF THE DRAWINGS

FIG. 1 illustrates a film unit 10 incorporating one embodiment of the present invention. The film unit has lateral and transverse edges and comprises a first sheet 12 which is provided on its inner surface with one or more photographic layers as disclosed, for example, in copending U.S. patent application Ser. No. 351,673, filed Apr. 16, 1973 in the name of Fleckenstein et al.; U.S. Pat. No. 3,880,658; and Canadian Pat. No. 928,559. As the film unit is processed it is transported between a pair of pressure applying members with the transverse edge 13, adjacent the processing-composition-containing container or pod 14, first. This transverse edge 13 is hereinafter referred to as the "leading" edge or end while the opposite transverse edge is called the "trailing" edge or end 15 of the film unit. In the film unit illustrated, the visible image occupies the area indicated by the dotted rectangle 16. In FIG. 1., portions of the film unit are broken away to show a portion of other elements of the film unit.

A second sheet 18, provided on its inner surface with suitable timing and neutralizing layers, is arranged in superposition with the first sheet 12 and is connected thereto by means of an intermediate sheet 20. As shown in FIG. 1, the second sheet 18 is substantially the same width as the first sheet 12, but is shorter. The difference in length between the first and second sheets 12 and 18 is just slightly greater than the narrow dimension of the fluid container or pod 14, i.e. the dimension of the pod from the leading end toward the trailing end of the film unit. The first and second sheets are superposed with the leading end 17 of the sheet 18 terminating short of the corresponding end of sheet 12.

As disclosed in copending U.S. patent application Ser. No. 570,904, filed Apr. 23, 1975, in the names of Tone and Borel, the trailing end portion of the second sheet is provided with a plurality of circular protuberances or embossments 22 which form a plurality of convexities on the outer surface of that sheet and a plurality of corresponding concavities on the inner surface thereof. FIG. 2 shows a cross section through these protuberances. These protuberances are arranged to space apart the pressure-applying members or rollers of a processing camera to assist in forming a trap or trapping volume or space 23 which receives and accommodates excess processing composition after it has been spread the length of the film unit. As illustrated, the protuberances are arranged in a plurality of rows extending transversely of the film unit, with the protuberances in one row offset from those in the adjacent row. A plurality of slits or perforations 24 are provided through the second sheet, between the trailing end and the protuberances, which act as flow passage means or valves that permit the excess processing composition forced to the trailing end of the film unit between the sheets to pass through the second sheet into the trapping space around the protuberances between the outer surface of the second sheet and a trap cover 36.

Figure 3:
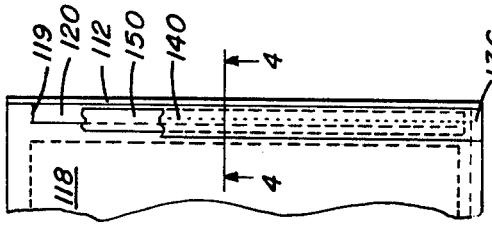
FIG. 3 is a partial plan view of the back surface of another embodiment of the present invention.

The trap cover 36 is formed by a portion of the intermediate sheet which extends from between the sheets at the trailing end of the film unit and is folded around the end of sheet 18, over the protuberances 22 to be sealed to the outer surface of sheet 18 ahead of the protuberances in the region 38. A row of air release perforations or holes 40 is formed through the trap cover to permit the escape of air therefrom in a manner described in U.S. Pat. Nos,. 2,500,422 and 2,627,460. The row of air release perforations extends transversely of the trailing end of the film unit and is disposed substantially midway between the leading and trailing edge of the trap spacing means, i.e. protuberances 22. Preferably, the air release perforations are of a size which permits the escape of air or gas from the trap region of the film unit and yet substantially precludes the escape of the processing composition. However, it has been found that despite the small size of the air release perforations, without the the use of the present invention, leakage of the processing composition is still possible. Thus, a processing-composition-impervious sheet element 42 is disposed between the convex portion of the protuberances 22 and the trap cover 36. This sheet element may be a thin layer of cellulose acetate, polyethylene, polyester, or other suitable material which is substantially impervious to the processing composition. The sheet element is substantially coextensive with the trap spacing means and extends from the trailing edge of the trap space 23 toward the leading edge, and from side-to-side of the film unit, substantially as shown. In this embodiment, the sheet element 42 is sealed transversely of the film unit to the trap cover at the trailing edge thereof at 44 as well as at the lateral edges thereof. Preferably, the seal 44 is continuous thereby precluding the processing composition, which is entering the trapping space 23 through slits 24, from entering the space between the sheet element 42 and the trap cover 36. The lateral edge seals are optional, providing some additional protection against leakage. With this construction, after the processing fluid is forced into the trap space 23, any air or gas forced ahead of the body or processing fluid is caused to flow through the trapping space, around the protuberances 22, toward the leading edge of the trap where it passes around the leading edge 46 of the sheet element into the space between the sheet element and the trap cover 36 to escape through perforations 40. Because of the viscosity of the processing composition, the narrow space between the trap cover and the sheet element, and the fact that another reversal of flow would be necessary, any possibility of the processing composition entering the space between the sheet element and the trap cover is substantially eliminated, thereby precluding any processing composition from reaching the air release perforations 40. As a result, any leakage of the processing composition through the air release perforations is essentially eliminated.

ALTERNATE EMBODIMENTS

Figure 4:
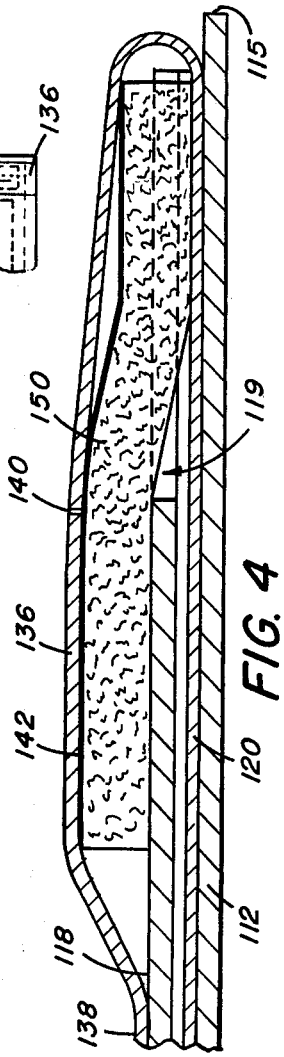
FIG. 4 is a partial cross section taken along line 4—4 of FIG. 3.
Figure 2:
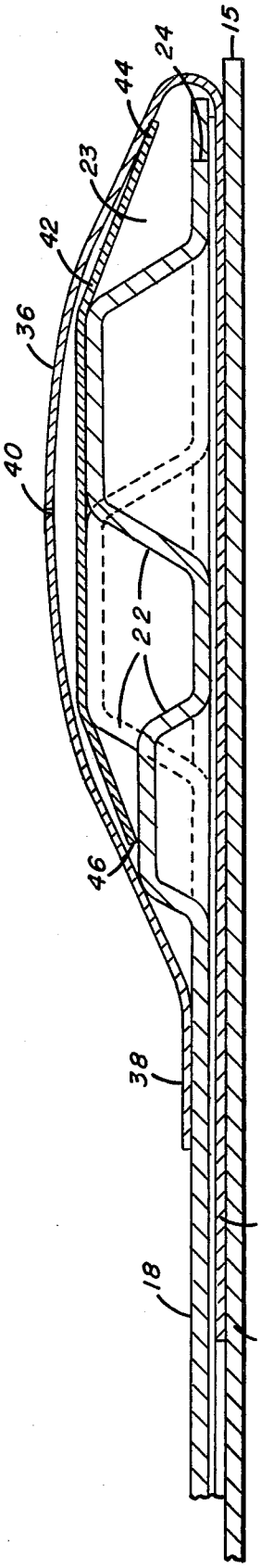
FIG. 2 is a partial cross section taken along line 2—2 of FIG. 1.
Figure 1:
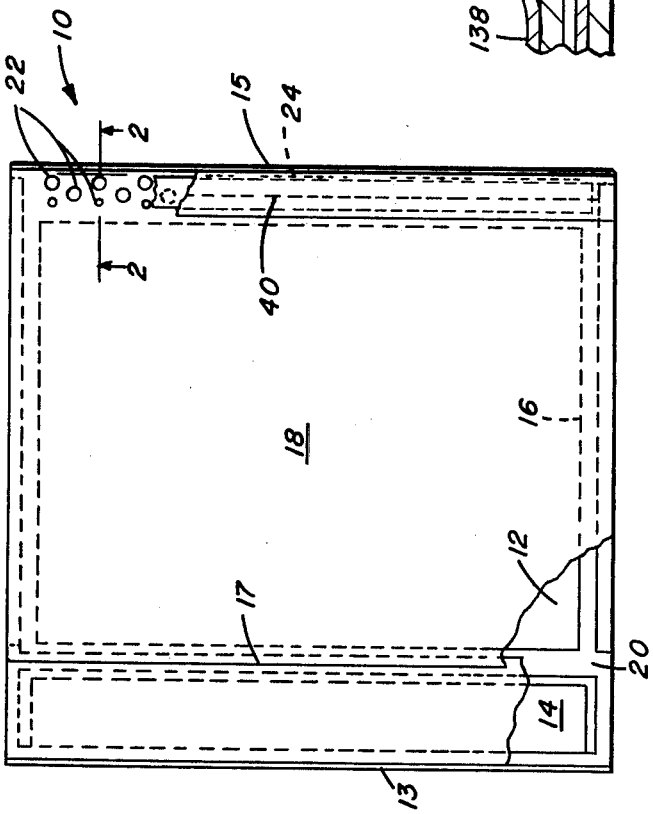
FIG. 1 is a plan view of the back surface of a film unit incorporating one embodiment of the present invention, with portions removed to show a portion of the inner construction.

An alternate embodiment is illustrated in FIGS. 3 and 4 and comprises a trap construction similar to that described in U.S. Pat. No. 2,686,716. Components of this embodiment are given the same reference numerals as the similar components in the first embodiment with the prefix "1". In this embodiment, the trap spacer element 150 is formed of a porous material such as cloth, gauze, velvet, glass, wool, blotting paper, felt, etc., formed of any suitable material which is substantially inert in the processing composition and which has sufficient stiffness to provide the pressure member spacing function common to such trap spacing elements. In this embodiment, the trailing end of sheet 118 is notched, as at 119, with the trap spacer element 150 lying in the cutout portion and over the trailing end portion of sheet 118 substantially as shown in FIGS. 3 and 4. With this trap spacer, the excess processing composition is retained within the fibrous structure of the spacer element 150. A processing-composition-impervious layer 142 is coated on the surface of the spacer element 150 which is adjacent the trap cover means 136 and provides the same preclusion of the processing composition from reaching the air release perforations 140 in the trap cover 136. In this embodiment, the impervious layer 142 may be a layer of a polymeric material, such as polyethylene, or other material coated directly on the surface of the spacer element 150. Alternatively, the processing-composition-impervious layer may be separately applied similar to that disclosed in the first embodiment. In this embodiment, the sealing of the impervious layer to the trap cover at the trailing end is not utilized because of the different fluid flow path into the trap space occasioned by the use of the alternate trap spacer element. However, it is possible to utilize a seal between impervious layer 142 and the trap cover 136 at the trailing end thereof to assure the prevention of processing composition flow at that location.

The trap spacer element 150 of the alternate embodiment can also be provided with a processing composition neutralization and/or coagulation substance which neutralizes and/or coagulates the processing composition within the trap spacer element substantially as taught by the U.S. Pat. No. 3,686,716 reference noted above. Similarly, the sheet element 42 of the first embodiment may also include a processing composition neutralization and/or coagulation agent coated thereon or impregnated therein to perform the same neutralization and/or coagulation of the processing composition.

Also, while the seal 44 between the sheet element 42 and the trap cover 36 is disclosed as being continuous, it will be appreciated that this seal can be completely omitted, or it may be merely a tack seal to hold the sheet element in position.

Alternatively, the seal 44 may be intermittent, being omitted where it is known that excess processing composition is unlikely to flow. Similarly, the perforations may be formed in a pattern such that they are omitted where the excess processing composition is likely to flow. This last embodiment is useful where the seal 44 is intermittent or is completely omitted.

It will thus be seen that the present invention provides a novel and unique processing-composition-impervious layer between the trap spacing element and the trap venting holes which substantially precludes the escape of the processing composition therethrough without significantly inhibiting the escape of air or gas. Accordingly, the air is permitted to escape, thus preventing the undesirable effect that air entrainment in the processing composition or the blow-back of the processing composition into the film unit can generate, while providing the necessary assurance that processing composition will not leak through the vent holes either during spread of the processing composition or handling of the film unit by the user subsequent to processing.

The invention has been described in detail with particular reference to different embodiments thereof, but it will be understood that variations and modifications can be effected within the spirit and scope of the invention.

I claim:

1. In a film unit comprising a photosensitive sheet and a second sheet, means securing the sheets together in superposed relationship, means for containing a processing composition disposed at one end of the film unit, and means for trapping excess processing composition disposed at the other end of the film unit, said trapping means comprising trap spacing means, trap cover means of sheet material overlying the spacing means, and trap venting means comprising a plurality of holes through said trap cover means, the improvement comprising:

processing-composition-impervious means disposed between said trap spacing means and said holes through said trap cover means.

2. The invention according to claim 1 wherein said impervious means is a layer on the surface of the spacing means adjacent said trap cover means.

3. The invention according to claim 1 wherein said impervious means is a sheet element disposed between the spacing means and the trap cover means.

4. The invention according to claim 1 wherein said impervious means is substantially coextensive with said spacing means.

5. The invention according to claim 1 wherein said impervious means is sealed to said trap cover means transversely of the film unit along one transverse edge of said trap spacing means.

6. In a film unit comprising a photosensitive sheet and a second sheet, a coupling member securing the sheets together along their lateral edges in superposed relationship, a container for processing composition disposed at the leading end of the film unit, a trap for excess processing composition disposed at the trailing end of the film unit and including trap spacing means and trap cover means overlying said spacing means, and trap-venting means comprising a plurality of holes through a portion of said trap cover means overlying said spacing means, the improvement comprising:

a processing-composition-impervious layer on the surface of and substantially coextensive with said trap spacing means adjacent said trap cover means, said impervious layer being sealed to said trap cover means transversely of said film unit along the trailing edge of said trap spacing means whereby said processing composition is restrained from reaching said trap-venting holes without restraining gas from reaching said venting holes for escape from said film unit.

7. In a film unit comprising a photosensitive sheet and a second sheet, a coupling member securing the sheets together along their lateral edges in superposed relationship, a container for processing composition disposed at the leading end of the film unit, a trap for excess processing composition disposed at the trailing end of the film unit and including trap spacing means and trap cover means overlying said spacing means, and trap-venting means comprising a plurality of holes through said trap cover means, the improvement comprising:

a processing-composition-impervious sheet element disposed between said trap spacing means and said holes through said trap cover means, said impervious sheet element being sealed to said trap cover means transversely of said film unit adjacent the trailing edge of said trap spacing means whereby said processing composition is restrained from reaching said trap-venting holes without restraining gas from reaching said venting holes for escape from said film unit.

8. The invention according to claim 7 wherein said venting holes through the trap cover means are disposed between the leading and trailing edges of said trap spacing means.

* * * * *